US007186937B1

(12) United States Patent
Ricciuti et al.

(10) Patent No.: US 7,186,937 B1
(45) Date of Patent: Mar. 6, 2007

(54) ROTATIONAL BACKLASH COMPENSATING CAM FOR STORED ENERGY CIRCUIT BREAKER CHARGING MOTOR CONTROL

(75) Inventors: Anthony Thomas Ricciuti, Bethel Park, PA (US); Thomas Kenneth Fogle, Pittsburgh, PA (US); James Jeffrey Benke, Pittsburgh, PA (US); Daniel Evan Palmieri, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/393,544

(22) Filed: Mar. 30, 2006

(51) Int. Cl.
*H01H 5/00* (2006.01)

(52) U.S. Cl. ..... 200/400; 218/154

(58) Field of Classification Search ..... 200/400, 200/401, 500, 501, 17 R, 318, 321, 322; 218/153, 154, 7, 14, 78, 140
See application file for complete search history.

(56) References Cited

U.S. PATENT DOCUMENTS 3,562,463 A * 2/1971 Charbonneau et al. ..... 200/425
3,773,995 A * 11/1973 Davies ..... 200/400
6,472,627 B1 * 10/2002 Yoon ..... 200/400
6,646,216 B2 * 11/2003 Fanta et al. ..... 200/400
7,019,606 B2 * 3/2006 Williams et al. ..... 335/20

OTHER PUBLICATIONS

Cutler-Hammer, Instructions for Installation, Operation and Maintenance of Type VCP-W Vacuum Circuit Breakers, pp. 1-60, I.B. 32-255-1FJul. 1997, Pittsburgh, PA.

* cited by examiner

*Primary Examiner*—Elvin Enad
*Assistant Examiner*—M. Fishman
(74) *Attorney, Agent, or Firm*—Martin J. Moran

(57) ABSTRACT

The present invention provides a motor control cam having a relief channel adjacent to the switch lever notch. The relief channel extends generally circumferentially from said switch lever notch under the second, wide diameter portion of the cam surface. In this configuration, when the switch lever is in the switch lever notch and a counter rotation of the cam occurs, the switch lever enters the relief channel and does not impact against the cam. As such, the switch lever is not damaged or moved out of adjustment by a counter rotation of the cam.

16 Claims, 6 Drawing Sheets

ROTATIONAL BACKLASH COMPENSATING CAM FOR STORED ENERGY CIRCUIT BREAKER CHARGING MOTOR CONTROL

BACKGROUND OF THE INVENTION

1. Field of the Invention

The present invention relates to a medium voltage switchgear having a circuit breaker, the circuit breaker having a charging motor actuated by a control switch with a switch lever, the switch lever engaging a control cam having a relief channel.

2. Background Information

A medium voltage switchgear typically comprises a switching mechanism housed in an enclosure. The switching mechanism, typically a circuit breaker, includes separable contacts for each phase and a common spring operated closing and tripping device. This device includes one or more opening springs which separates the contacts and a pair of closing springs which close the contacts and charge the opening spring. The separable contacts are closed by releasing the energy stored in the closing springs through activation of a closing trigger mechanism. This can be done manually or remotely through a solenoid. An electronic trip circuit monitors the load currents and actuates an opening trigger mechanism through an opening solenoid if the current exceeds certain current-time characteristics. The closing springs are charged manually by a lever arm through a ratchet coupling, or, more preferably, by a motor.

The motor is coupled to a crank shaft. The crank shaft is further coupled to the closing springs, the opening springs and a pole shaft. The pole shaft is coupled to the contacts. In operation, the motor rotates the crank shaft to charge the closing springs. When the closing springs are released, the closing springs cause the crank shaft to rotate and this motion is transferred to the pole shaft which closes the contacts. At this point, the closing springs are typically recharged so that the circuit breaker may be closed again after being tripped.

The motor may be controlled by a motor control switch mounted adjacent to the crank shaft. The motor control switch includes a switch lever that contacts a motor control cam. The motor control cam is fixedly coupled to the crank shaft and has a cam surface with a first, reduced diameter portion and a second, wide diameter portion. Each portion of the cam surface extends about 180 degrees about the motor control cam. At one boundary between the first, reduced diameter portion and the second, wide diameter portion is a switch lever notch. The switch lever notch is, essentially, a radial edge on the cam surface. When the switch lever is in contact with the first, reduced diameter portion, the motor control switch does not actuate, that is, turn on, the motor. When the switch lever is in contact with the second, wide diameter portion, the motor control switch actuates the motor. The motor control cam is coupled to the crank shaft so that when the closing springs are charged, the switch lever is disposed in the switch lever notch and at the beginning of the first, reduced diameter portion. Thus, when the closing springs are charged, the motor is not actuated. When the closing springs are released, the crank shaft rotates about 180 degrees so that the switch lever is disposed on the second, wide diameter portion. Accordingly, after the closing springs are released, the motor is actuated causing the crank shaft to rotate and charge the closing springs. When the closing springs are charged, the crank shaft has rotated about 180 degrees and the switch lever falls into the switch lever notch, causing the motor to stop. During these operations, the crank shaft, and therefore the motor control cam, are intended to rotate in a single direction.

The disadvantage to this configuration is that various tolerances in the circuit breaker components, wear and tear, and other factors may allow the crank shaft to counter-rotate. That is, the crank shaft, and therefore the motor control cam, may rotate in the opposite direction. Thus, because the switch lever notch is, essentially, a radial edge on the cam surface, counter rotation of the motor control cam may cause the radial edge of the switch lever notch to impact the switch lever. This impact may damage the switch lever or move the switch lever out of the optimal position.

There is, therefore, a need for a motor control cam structured to not impact the switch lever during a counter rotation of the crank shaft.

There is a further need for a motor control cam that may be incorporated into existing circuit breakers.

SUMMARY OF THE INVENTION

These needs, and others, are met by the present invention which provides a motor control cam having a relief channel adjacent to the switch lever notch. The relief channel extends generally circumferentially from said switch lever notch under the second, wide diameter portion of the cam surface. In this configuration, when the switch lever is in the switch lever notch and a counter rotation of the cam occurs, the switch lever enters the relief channel and does not impact against the cam. As such, the switch lever is not damaged or moved out of adjustment by a counter rotation of the cam. Such a cam may be easily incorporated into existing circuit breakers.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
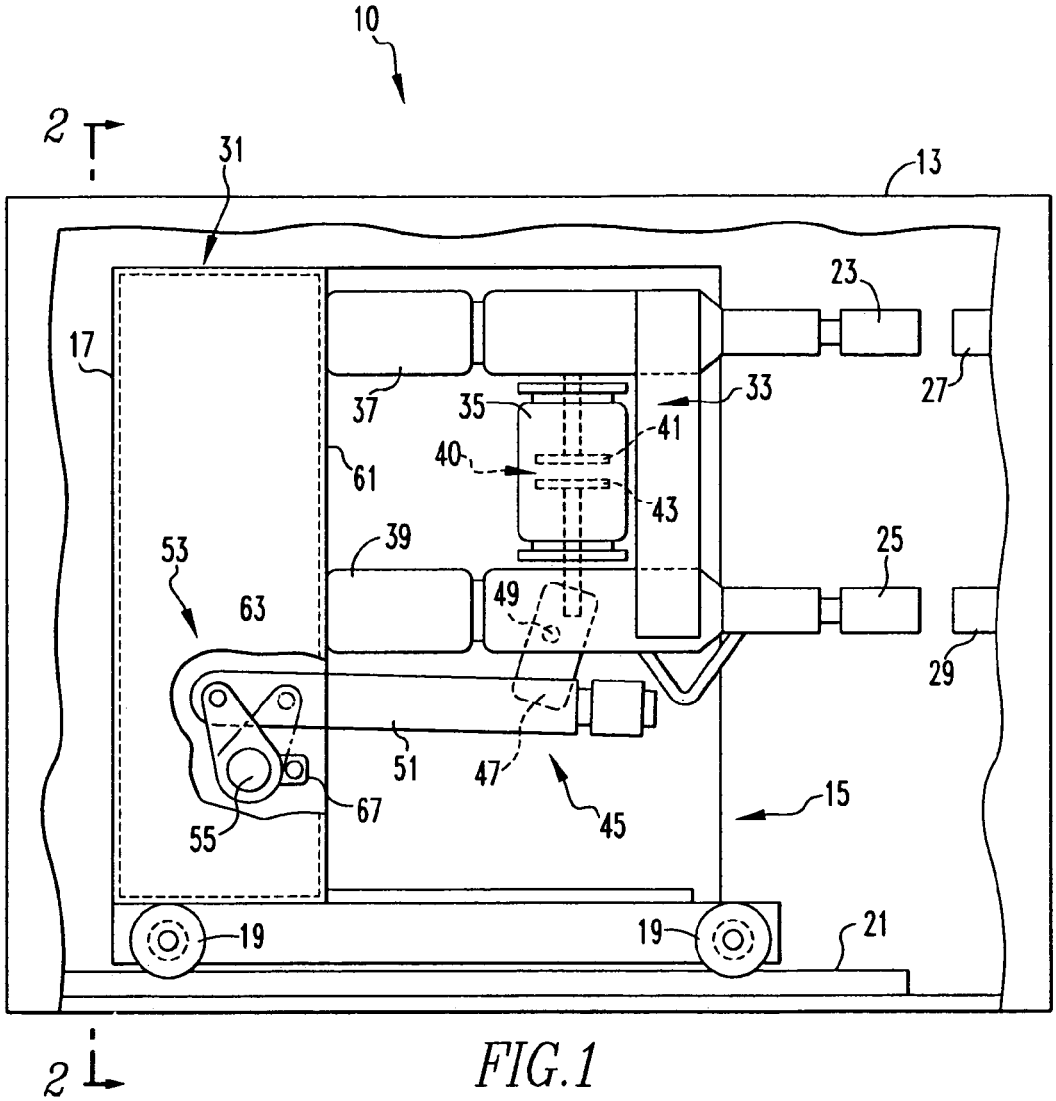
FIG. 1 is a side elevational view with some parts cut away with a typical medium voltage circuit breaker in accordance with the invention shown in the disconnected position.
Figure 2:
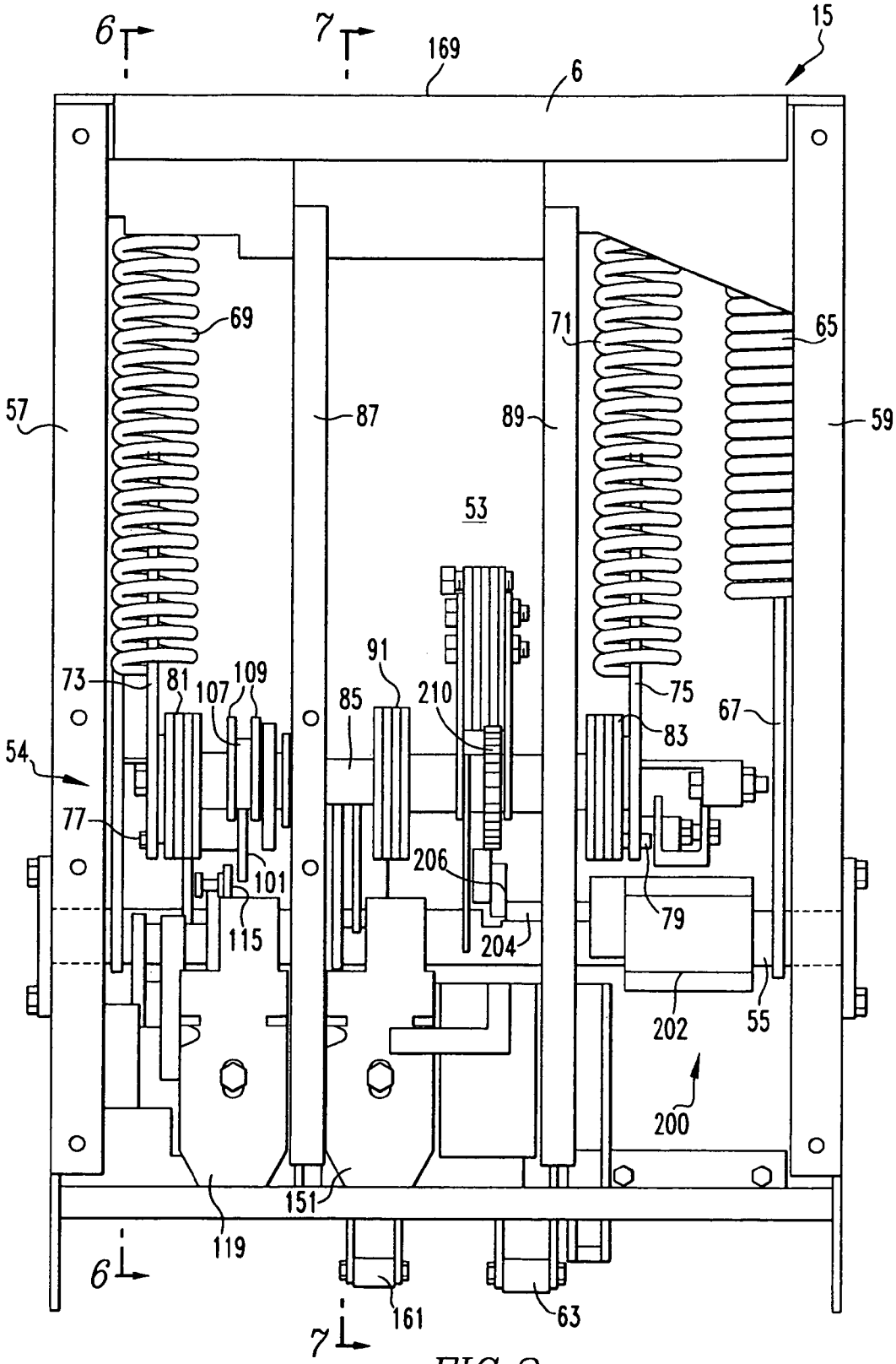
FIG. 2 is a front elevational view of a typical circuit breaker as seen in FIG. 1 with the cover removed.

As shown in FIGS. 1 and 2, a switch gear apparatus 10 includes a cabinet or enclosure 13 for enclosing a circuit breaker 15. The exemplary circuit breaker 15 is, preferably, a draw-out three-phase vacuum circuit interrupter having controls on a front panel 17 for manually operating the circuit breaker 15. The circuit breaker 15 has wheels 19 which engage rails 21 for inserting the circuit breaker 15 into and removing the circuit breaker 15 from the enclosure 13. The enclosure 13 includes at least one line terminal 27 and at least one load terminal 29. The circuit breaker 15 includes at least one line terminal 23 and at least one load terminal 25. Typically, the switch gear apparatus 10 has three circuit breaker line and load terminals 23, 25 and three corresponding enclosure line and load terminals 27, 29. The circuit breaker line and load terminals 23, 25 are positioned to engage, and be electrically coupled to, the enclosure line and load terminals 27, 29. Movement of the circuit breaker 15 along the rails 21 also effects connection and disconnection of circuit breaker line and load terminals 23, 25 with the enclosure line and load terminals 27, 29. While a medium voltage vacuum interrupter is shown for the circuit breaker 15, the invention is also applicable for use with air circuit breakers.

The circuit breaker 15 has a front low voltage section 31 adjacent to the front panel 17 and a rear high voltage section 33 containing a vacuum interrupter 35 for each phase. The low and high voltage sections 31, 33 are electrically insulated from each other by upper and lower insulators 37, 39. Within each vacuum interrupter 35, a pair of separable contacts 40 including a stationary contact 41 and a moveable contact 43 are provided. The contacts 40 are operated between the open position (shown) and a closed position by a linkage 45 which includes a bell crank 47 (shown schematically) pivoted at pivot point 49 and an insulated push rod 51 extending into the low voltage section 31.

An operating mechanism 53 for opening and closing the separable contacts 40 through the linkage 45 is contained in the low voltage section 31. This operating mechanism 53 has a number of driven parts 54 which include a pole shaft 55 which is rotatably journaled in side walls 57, 59 of a housing 61 (FIG. 2). A pole arm 63 (FIG. 1) for each phase projects laterally from the pole shaft 55 and is pivotally connected to the associated push rod 51 so that rotation of the pole shaft 55 simultaneously opens or closes the separable contacts 40 of each pole. The pole shaft 55 is rotated counter-clockwise as viewed in FIG. 1 to open the contacts 40 by an opening spring 65 in the form of a helical tension spring connected at one end to an upper portion of the housing 61 of the low voltage section 31 and at the other end to a lever arm 67 mounted on the pole shaft 55.

The operating mechanism 53 also includes a pair of helical tension closing springs 69, 71 each of which is connected at its upper end to the housing 61 and at its lower end through a spring link 73, 75 to an eccentric pivot 77, 79 on a spring crank 81, 83, respectively. The spring cranks 81, 83 are mounted on opposite ends of a crank shaft 85 rotatably supported between a pair of spaced supports 87, 89. Fixed on the crank shaft 85 between the supports 87, 89 is a closing cam 91 which includes a notch 93 in the peripheral cam surface thereof (see FIGS. 7*a–c*).

Figure 3:
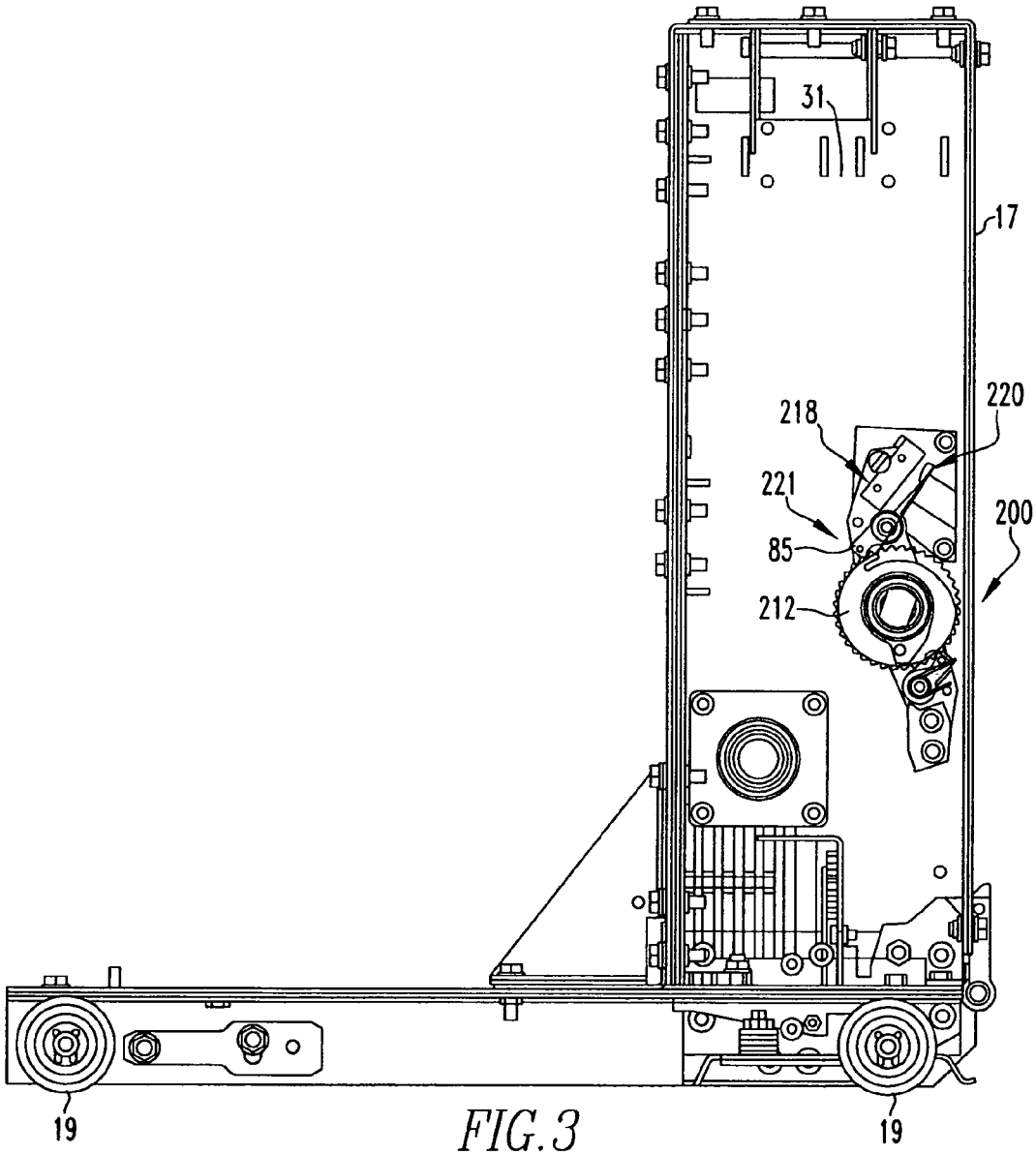
FIG. 3 is a partial side view of a circuit breaker.
Figure 4:
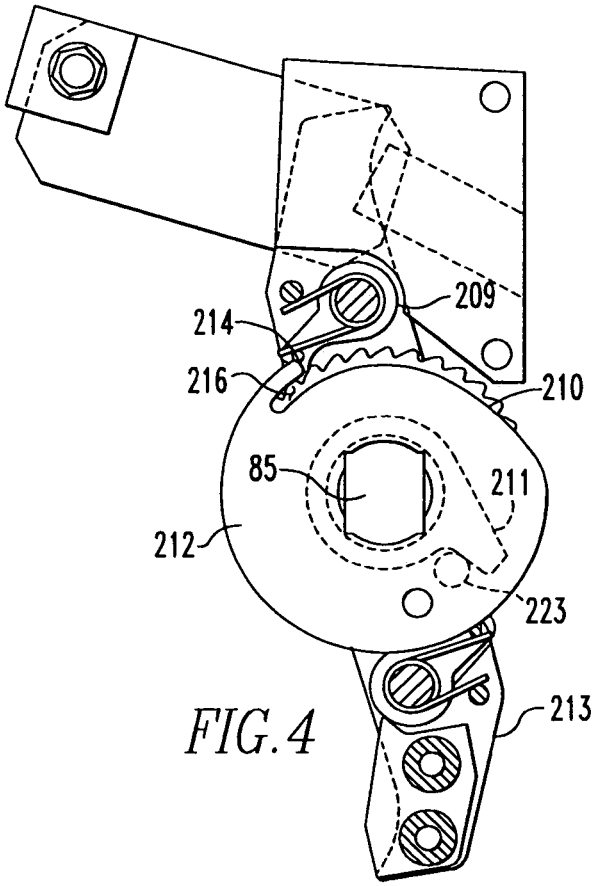
FIG. 4 is a detailed side view of a portion of the charging mechanism.
Figure 5:
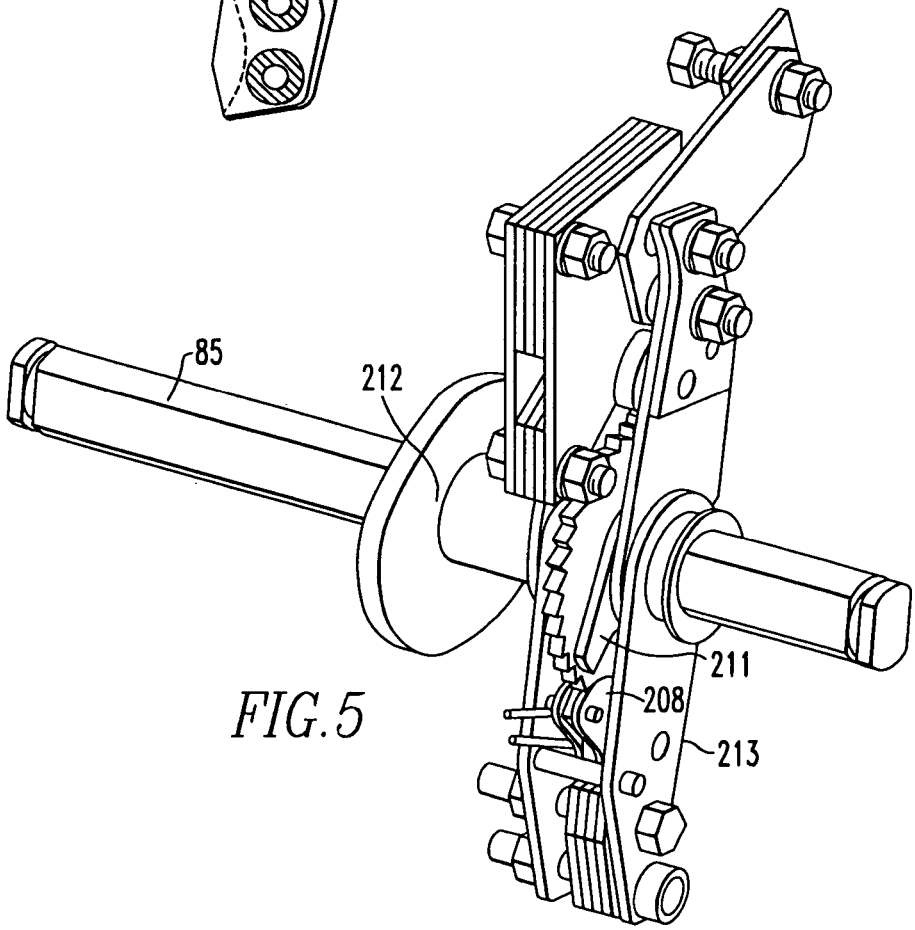
FIG. 5 is an isometric view of the charging mechanism shown in FIG. 4.

The crank shaft 85 is rotated to extend or charge the two closing springs 69, 71 by a charging mechanism 200. As shown in FIG. 2, the charging mechanism 200 includes a motor 202, preferably electric, having a motor shaft 204, and a drive eccentric 206. As further shown in FIGS. 3–5, the charging mechanism 200 further includes at least one charge pawl 208, at least one hold pawl 209 a ratchet wheel 210, at least one charging plate 211, at least one drive lever 213, a motor control cam 212 having a switch lever notch 214 with a relief channel 216 (FIG. 8), and a motor control switch 218 having a switch lever 220. The switch lever 220 is, preferably, a rectangular beam 221 having a diameter thickness between about 0.031 and 0.062 inch, and more preferably about 0.040 inch. The motor shaft 204 extends in a direction generally parallel to the crank shaft 85. The drive eccentric 206 is coupled to the motor shaft 204. The ratchet wheel 210 is fixedly mounted to freely rotate about the crank shaft 85 within rotational boundaries set by an integral detent 223 and at least one charging plate 211. The at least one charging plate 211 is fixedly mounted to the crank shaft 85. The charge pawl 208 is coupled to at least one drive lever 213, which in turn freely rotates about the crank shaft 85. The drive gear eccentric 206 is structured to operatively engage the ratchet wheel 210 through at least one drive lever 213 so that, when the motor 202 is energized, the crank shaft 85 is rotated counterclockwise as shown by the arrows in FIGS. 7*a–c*. That is, rotation of the motor shaft 204 is transferred to the crank shaft 85 via the linking of the drive eccentric 206, the charge pawl 208, at least one drive lever 213, and the ratchet wheel 210. Reverse rotation of the crank shaft 85 is substantially limited by the at least hold one pawl 209 which is coupled to the housing 61 and also structured to engage the ratchet wheel 210.

The motor control cam 212 is also fixedly coupled to the crank shaft 85. The motor control switch 218 is coupled to the housing 61 adjacent to the motor control cam 212. The motor control switch lever 220 extends toward and engages the cam surface of the motor control cam 212. The motor control switch 218 is electrically coupled to the motor 202 and provides a control signal thereto. That is, the motor control switch 218 is structured to selectively actuate the motor 202 in response to the position of the switch lever 220. The switch lever 220 is structured to engage the motor control cam 212 and move in response to the changing diameter of the motor control cam 212. The motor control cam 212 includes a first, reduced diameter portion 230, and a second, wide diameter portion 232. The switch lever notch 214 is located at one boundary between the first, reduced diameter portion 230, and the second, wide diameter portion 232. The motor control switch 218 is structured to provide an actuation signal to the motor 202 when the motor control switch lever 220 engages the second, wide diameter portion 232 of the motor control cam 212. When the motor control switch lever 220 engages the first, reduced diameter portion 230 of the motor control cam 212 the motor 202 is not actuated.

Alternatively, as is known, the crank shaft 85 can be manually rotated to charge the closing springs 69, 71 by a charging lever (not shown) which engages the charging mechanism 200. The closing springs 69, 71 are retained in the charged condition and released by a first, closing spring release 99 (see FIGS. 6*a* and *b*) which includes a closing spring release latch 101 pivotally connected on a shaft 103. This closing spring release latch 101 has a latch surface 105 which is engaged by a latch roller 107 supported between a pair of roller support arms 109 fixed to the crank shaft 85.

Figure 6A:
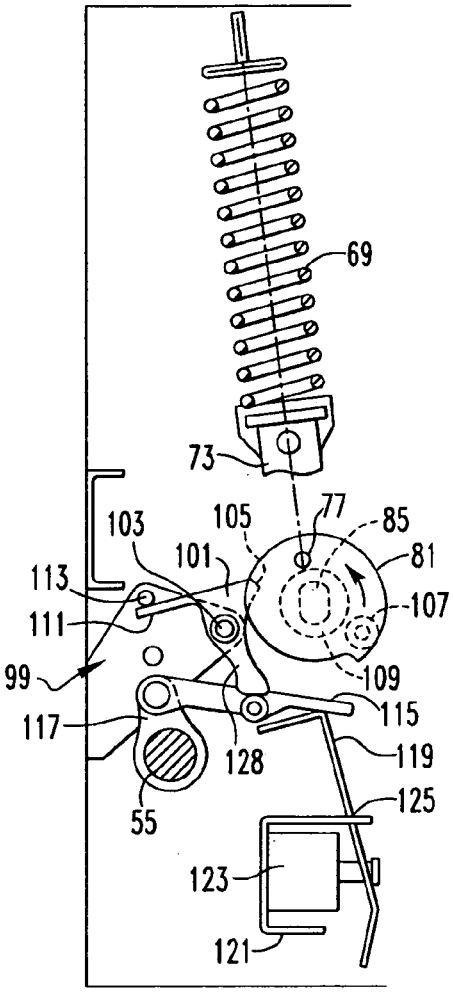
FIG. 6*a* is a sectional view taken along the line 6—6 in FIG. 2 shown with the breaker in the open position and the closing springs discharged.

With the circuit breaker 15 open and the closing springs 69, 71 discharged as shown in FIG. 6*a*, operation of the charging mechanism 200 causes the crank shaft 85 to rotate in a counterclockwise direction as shown by the arrow. This causes the eccentric pivots 77, 79 to move downward thereby extending the closing springs 69, 71. Just after the eccentric pivots 77, 79 carry the lines of action of the closing springs 69, 71 through the center of the crank shaft 85, the closing latch roller 107 engages the latch surface 105 on the closing spring release latch 101. The tendency of the closing spring 69, 71 to continue the rotation in the clockwise direction is blocked by the engagement of an extension 111 on the release latch 101 with a fixed pin 113.

Figure 6B:
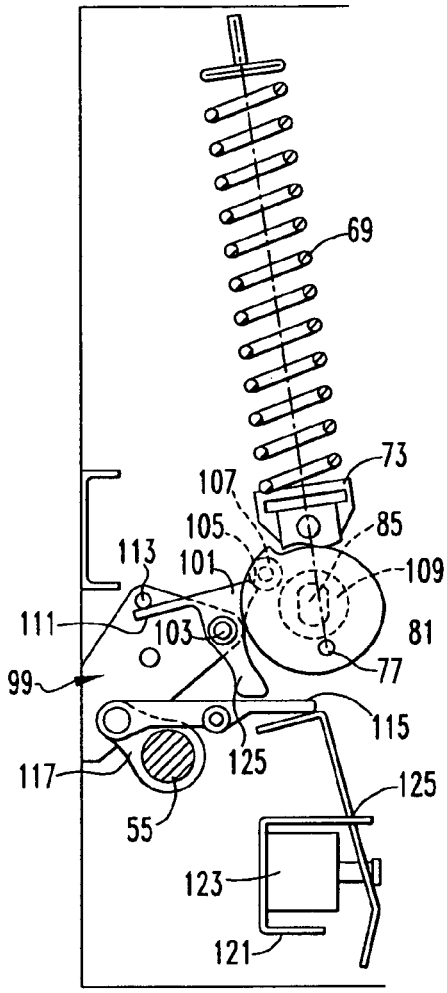
FIG. 6*b* is similar to FIG. 6*a* but showing the breaker closed with the closing springs charged.

The release latch 101 is operated by a release lever 115 pivotally connected at one end to an arm 117 on the pole shaft 55. The other end of the release lever 115 rests on a close clapper 119. The close clapper 119, in turn, is pivotally supported on a bracket 121 which also supports a close solenoid 123. Rotation of the close clapper 119 counterclockwise in FIG. 6*a* about a pivot axis 125, either manually by pressing on the lower end of the clapper 119, or automatically by energization of the close solenoid 123, causes clockwise rotation of the release lever 115. The release lever 115 engages a projection 128 on the close spring release latch 101 which is rotated clockwise until the close latch roller 107 slips off of the latch surface 105. This permits the closing springs 69, 71 to rapidly rotate the crank shaft 85. This results in rotation of the pole shaft 55 to close the separable contacts 40 of the circuit breaker 15. The force generated by two closings springs 69, 71 is required as they not only operate the mechanism 53 to close the separable contacts 40, but they also charge the opening spring 65. With the circuit breaker 15 closed as shown in FIG. 6*b*, the release lever 115 is lowered so that if the closing springs 69, 71 are recharged (as shown), the release lever 115 will not engage the closing spring release latch 101 and thus the closing springs 69, 71 cannot be discharged. The closing springs 69, 71 maintain the circuit breaker 15 ready for a recharge should the circuit breaker 15 trip open.

Figure 7C:
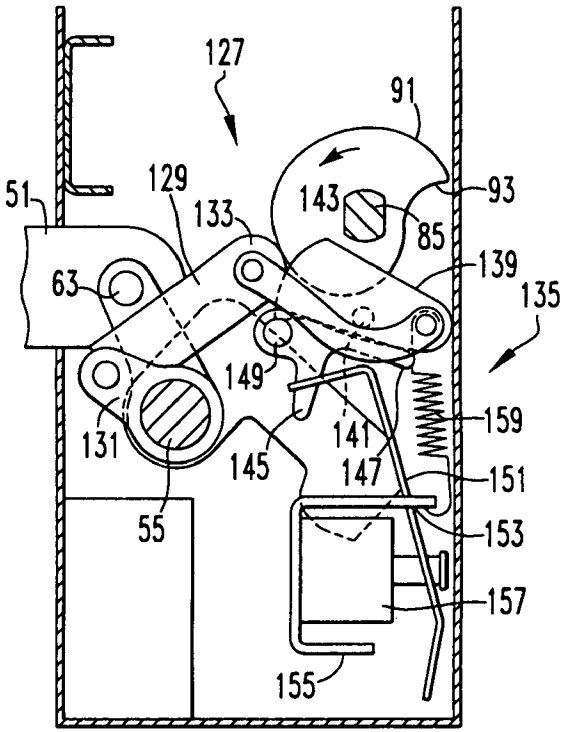
FIG. 7*c* is similar to FIGS. 7*a* and 7*b* but showing the breaker closed and the closing springs discharged.
Figure 7B:
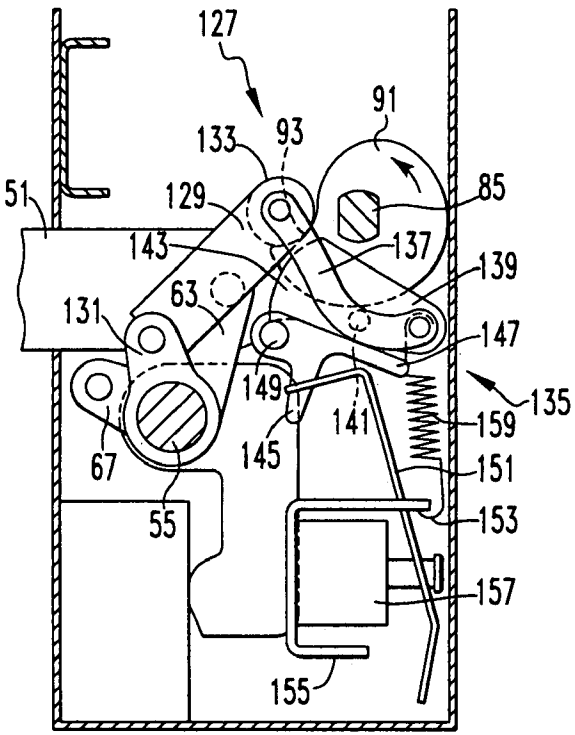
FIG. 7*b* is similar to FIG. 7*a* but showing the breaker in the open position and the closing springs charged.
Figure 7A:
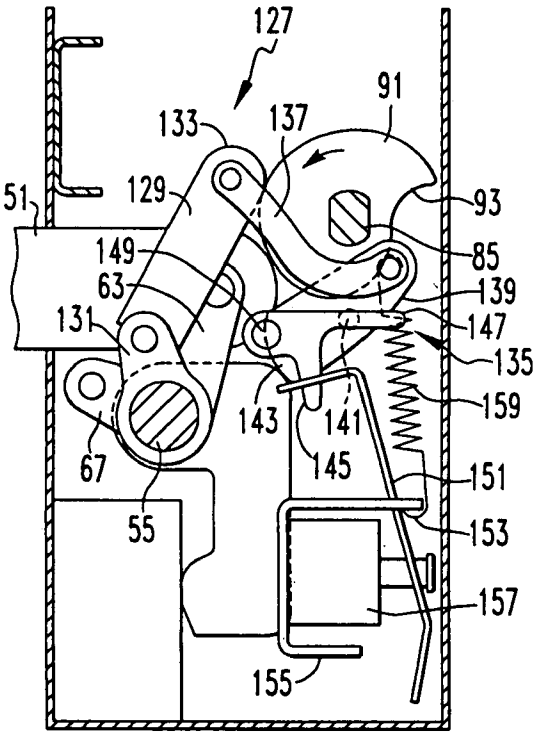
FIG. 7*a* is a sectional view taken along the line 7—7 in FIG. 2 showing the breaker open and the closing spring discharged.

As shown in FIGS. 7*a*–7*c*, the operating mechanism 53 also includes a coupling mechanism 127 for coupling the crank shaft 85 to the pole shaft 55. This coupling mechanism 127 includes a pair of parallel main links 129 each pivotally connected at one end to the pole shaft 55 through a crank arm 131 and rotatably supporting a main link roller 133 between their free ends. This main link roller 133 engages the peripheral surface of the closing cam 91 which, as the crank shaft 85 rotates, pushes on the main links 129 to rotate the pole shaft 55 through the eccentricity in the cam 91 surface. Opening spring release mechanism 135 includes a banana link 137 pivoted at one end on a common axis 125 with the main roller link 133 and at the other end to one end of a hatchet 139. The hatchet 139 is mounted on a fixed pivot pin 141 and has a free curved end 143 forming a latch edge 145. Opening spring release mechanism 135 also includes a trip lever 147 fixed to a rotatable trip lever "D" shaft 149. The trip lever 147 rests on the upper end of an opening clapper 151 pivotally supported at second pivot point 153 by a bracket 155 on which is mounted an opening solenoid 157. A trip latch reset spring 159 connected to this bracket 155, biases the hatchet 139 clockwise as shown in FIG. 7*a* to the hatchet 139 position as shown in FIGS. 7*b* and 7*c* wherein the latch edge 145 is engaged by the D shaft 149.

FIGS. 7*a*–*c* illustrate the coupling of the crank shaft 85 to the pole shaft 55 to close the circuit breaker 15 and tripping of the opening spring release mechanism 135 to open the circuit breaker 15. FIG. 7*a* illustrates the position of the parts with the circuit breaker 15 open and the closing springs 69, 71 discharged. As can be seen, the push rod 51 is retracted so that the separable contacts 40 are open. The sequence is initiated by operation of the charging mechanism 200 to rotate the crank shaft 85 in the counterclockwise direction to charge the closing springs 69, 71 in the manner described above. The trip latch reset spring 159 biases the main link roller 133 against the peripheral caming surface of the closing cam 91 until it falls into the notch 93 with the closing springs 69, 71 latched in the charged condition. This permits the trip latch reset spring 159 to rotate the hatchet 139 clockwise to the latched position in which the latch edge 145 is engaged by the D shaft 149 as shown in FIG. 7*b*. When the closing spring release 99 is actuated, the closing springs 69, 71 rapidly rotate the crank shaft 85 in the manner described above with reference to FIGS. 6*a* and 6*b*. The increasing effective diameter of the closing cam 91 produced by the eccentricity of the cam 91 surface, pushes the main links 129 downward and to the position shown in FIG. 7*c*. This rotates the pole shaft 55 in the counterclockwise direction to drive the push rod 51 to the left to close the separable contacts 40 while, as can be seen in FIG. 7*c*, the hatchet 139 remains engaged by the D shaft 149.

The circuit breaker 15 is opened manually by pressing on the lower end of the opening clapper 151. In addition, the circuit breaker 15 can be opened automatically by actuation of the opening solenoid 157 which rotates the opening clapper 151 clockwise. The opening solenoid 157 is energized by an electronic trip unit in response to current which exceeds predetermined current/time characteristics. Alternatively, the opening solenoid 157 can be energized from a remote source to open the circuit breaker 15. In any case, rotation of the opening clapper 151 in the clockwise direction rotates the open trip lever 147 and with it the D shaft 149. The force generated by the charged opening spring 65 through the main links 129 and banana link 137 rotates the hatchet 139 counterclockwise past the D shaft 149. This allows the opening spring 65 to rotate the pole shaft 55 to withdraw the push rods 51 and open the separable contacts 40 as the main link roller 133 rolls along the outer surface of the closing cam 91 to the position shown in FIG. 7*a*.

In each of the steps identified above wherein the operation of the charging mechanism 200 causes the crank shaft 85 to rotate, the motor 202 is actuated by the position of the motor control switch lever 220. That is, the motor control cam 212 is coupled to the crank shaft 85 so that when the closing springs 69, 71 are fully charged, the motor control switch lever 220 moves from the second, wide diameter portion 232 of the motor control cam 212 into the switch lever notch 214. In this configuration, the motor control switch lever 220 will be disposed on the first, reduced diameter portion 230 during normal operation of the circuit breaker 15 and when the closing springs 69, 71 are discharged during the charging of the opening spring 65. The discharging of the closing springs 69, 71 causes the crank shaft 85 to rotate so that the motor control switch lever 220 is disposed on the second, wide diameter portion 232 of the motor control cam 212. Thus, after the discharge of the closing springs 69, 71, the motor 202 is actuated causing the closing springs 69, 71 to be charged once again.

Figure 8:
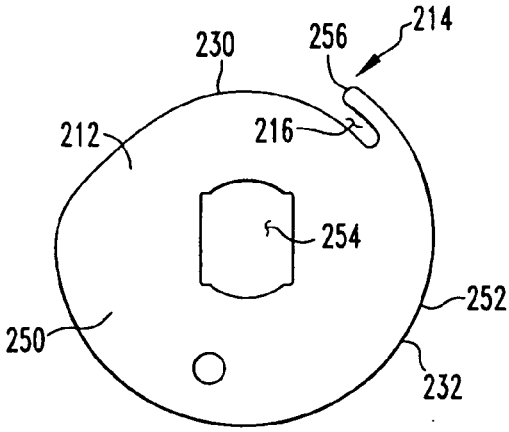
FIG. 8 is a side view of the motor control cam having a relief channel.

As shown in FIG. 8, the motor control cam 212 has a generally disk-like body 250 with an outer edge 252. The outer edge 252 is a cam surface 253 that has, as noted above, a first, reduced diameter portion 230 and a second, wide diameter portion 232. The motor control cam body 250 has a central opening 254 sized to accommodate the crank shaft 85. The switch lever notch 214 is a radial edge on the cam surface 253 delineating one boundary between the first, reduced diameter portion 230 and the second, wide diameter portion 232. That is, the outer edge 252 changes between the first, reduced diameter portion 230 and the second, wide diameter portion 232 at, essentially, a single point. The switch lever notch 214 may, however, have a rounded distal tip 256 at the end of the second, wide diameter portion 232. Between the distal tip 256 and the central opening 254 is the relief channel 216. The relief channel 216 extends from the switch lever notch 214 generally circumferentially a distance, between about 0.362 and 0.460 inch, and more preferably about 0.411 inch, between the central opening 254 and the outer edge 252 and under the second, wide diameter portion 232. The relief channel 216 has a radial width sized to accommodate the motor control switch lever 220. Preferably, the relief channel 216 radial width is between about 0.146 and 0.166 inch, and more preferably about 0.156 inch.

The relief channel 216 on the motor control cam 212 allows for the counter-rotation of the motor control cam 212. That is, while charging the charging mechanism 200, the at least one holding pawl 209 substantially resists the counter-rotation of the crank shaft 85, various tolerances within the operating mechanism 53 may allow the crank shaft 85 to rotate, slightly, in a reverse direction. When the crank shaft 85 counter-rotates, the motor control switch lever 220 moves into the relief channel 216 as opposed to abutting the switch lever notch 214. In this configuration, the motor control switch lever 220 will not be damaged by counter-rotation of the motor control cam 212.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A motor control cam for a switch gear apparatus, said switch gear apparatus having a circuit breaker and an enclosure, said circuit breaker having a housing with separable contacts disposed therein, an operating mechanism structured to open and close said separable contacts, said operating mechanism having a crank shaft, said crank shaft rotatably coupled to said housing, an opening spring coupled to said housing and to said crank shaft, said opening spring structured to rotate said crank shaft to open said separable contacts when released, a closing spring coupled to said housing and to said crank shaft, said closing spring structured to rotate said crank shaft to close said separable contacts and to charge said opening spring when released, a charging mechanism structured to charge said closing spring, said charging mechanism having a motor and a motor control switch with a switch lever, said motor coupled to said housing and structured to engage said crank shaft, said motor control switch structured to selectively actuate said motor in response to the position of said switch lever, said switch lever disposed adjacent to said crank shaft and is structured to engage said motor control cam, said motor control cam comprising:

a disk-like body with an outer edge cam surface, a central opening sized to accommodate said crank shaft, a switch lever notch and a relief channel;

said outer edge having a first, reduced diameter portion and a second, wide diameter portion;

said switch lever notch disposed at one boundary between said first, reduced diameter portion and said second, wide diameter portion;

said relief channel extending, generally circumferentially, from said switch lever notch under the second, wide diameter portion of said outer edge cam surface; and wherein, when said body is fixedly coupled to said crank shaft, said switch lever engages said outer edge cam surface and wherein, in the event of a reverse rotation of said crank shaft when said switch lever is disposed at said switch lever notch, said switch lever enters said relief channel.

2. The motor control cam of claim 1 wherein said relief channel has a radial width between about 0.146 and 0.166 inch.

3. The motor control cam of claim 2 wherein said relief channel has a radial width of about 0.156 inch.

4. The motor control cam of claim 1 wherein said relief channel has a length of between about 0.362 and 0.460 inch.

5. The motor control cam of claim 4 wherein said relief channel has a length of about 0.411 inch.

6. The motor control cam of claim 1 wherein said switch lever notch is a radial edge on the cam surface delineating one boundary between said first, reduced diameter portion and said second, wide diameter portion.

7. A circuit breaker comprising:

a housing with separable contacts disposed therein;

an operating mechanism structured to open and close said separable contacts, said operating mechanism having a crank shaft, an opening spring, a closing spring, and a charging mechanism;

said crank shaft rotatably coupled to said housing, said opening spring coupled to said housing and to said crank shaft and structured to rotate said crank shaft to open said separable contacts when released;

said closing spring coupled to said housing and to said crank shaft and structured to rotate said crank shaft to close said separable contacts and to charge said opening spring when released;

said charging mechanism structured to charge said closing spring, said charging mechanism having a motor, a motor control cam and a motor control switch with a switch lever;

said motor coupled to said housing and structured to engage said crank shaft;

said motor control switch structured to selectively actuate said motor in response to the position of said switch lever;

said switch lever disposed adjacent to said crank shaft and is structured to engage said motor control cam;

said motor control cam having a disk-like body with an outer edge cam surface, a central opening sized to accommodate said crank shaft, a switch lever notch and a relief channel;

said outer edge having a first, reduced diameter portion and a second, wide diameter portion;

said switch lever notch disposed at one boundary between said first, reduced diameter portion and said second, wide diameter portion;

said relief channel extending, generally circumferentially, from said switch lever notch under the second, wide diameter portion of said outer edge cam surface; and wherein, when said body is fixedly coupled to said crank shaft, said switch lever engages said outer edge cam surface and wherein, in the event of a reverse rotation of said crank shaft when said switch lever is disposed at said switch lever notch, said switch lever enters said relief channel.

8. The circuit breaker of claim 7 wherein said relief channel has a radial width between about 0.146 and 0.166 inch.

9. The circuit breaker of claim 8 wherein said switch lever is generally rectangular having a thickness of between about 0.031 and 0.062 inch.

10. The circuit breaker of claim 8 wherein said relief channel has a radial width of about 0.156 inch.

11. The circuit breaker of claim 10 wherein said switch lever is generally rectangular having a thickness of about 0.040 inch.

12. The circuit breaker of claim 7 wherein said relief channel has a length of between about 0.362 and 0.460 inch.

13. The circuit breaker of claim 10 wherein said relief channel has a length of about 0.411 inch.

14. The circuit breaker of claim 7 wherein said switch lever notch is a radial edge on the cam surface delineating one boundary between said first, reduced diameter portion and said second, wide diameter portion.

15. The circuit breaker of claim 7 wherein:

said charging mechanism includes a motor shaft extending from said motor, a drive eccentric, a charge pawl, a hold pawl, at least one charging plate, at least one drive lever, and a ratchet wheel;

said motor shaft extending in a direction generally parallel to said crank shaft;

said drive eccentric disposed on said motor shaft, said drive eccentric structured to engage said at least one drive lever;

said charge pawl disposed on said at least one drive lever structured to engage said ratchet wheel;

said ratchet wheel disposed on said crank shaft structured to engage said at least one charging plate;

said at least one charging plate fixedly coupled to said crank shaft;

said switch lever extending in a direction generally perpendicular to said crank shaft and structured to engage said outer edge cam surface;

wherein, as said motor control cam rotates with said crank shaft, said switch lever engages either said first, reduced diameter portion or said second, wide diameter portion; and wherein said motor control switch provides an actuating signal to said motor when said switch lever engages said second, wide diameter portion.

16. The circuit breaker of claim 15 wherein:

said charging mechanism includes at least one hold pawl coupled to said housing and also structured to engage said ratchet wheel.

* * * * *